US011981462B2

(12) United States Patent
Lemay et al.

(10) Patent No.: US 11,981,462 B2
(45) Date of Patent: May 14, 2024

(54) MACHINE AND A PROCESS FOR MANUFACTURING POUCHES CONTAINING A COHESIONLESS MATERIAL

(71) Applicant: G.D S.p.A., Bologna (IT)

(72) Inventors: Michael Andre Lemay, Bologna (IT); Mark Roland Godon, Bologna (IT)

(73) Assignee: G.D S.P.A., Bologna (IT)

( * ) Notice: Subject to any disclaimer, the term of this patent is extended or adjusted under 35 U.S.C. 154(b) by 185 days.

(21) Appl. No.: 17/432,252

(22) PCT Filed: Mar. 20, 2019

(86) PCT No.: PCT/IB2019/052248
§ 371 (c)(1),
(2) Date: Aug. 19, 2021

(87) PCT Pub. No.: WO2020/188320
PCT Pub. Date: Sep. 24, 2020

(65) Prior Publication Data
US 2022/0169405 A1 Jun. 2, 2022

(51) Int. Cl.

| | |
|---|---|
| ***B65B 1/06*** | (2006.01) |
| ***B65B 11/48*** | (2006.01) |
| ***B65B 29/02*** | (2006.01) |
| ***B65B 37/02*** | (2006.01) |
| ***B65B 37/08*** | (2006.01) |
| ***B65B 51/26*** | (2006.01) |

(52) U.S. Cl.
CPC ..... *B65B 1/06* (2013.01); *B65B 11/48* (2013.01); *B65B 29/028* (2017.08); *B65B 37/02* (2013.01); *B65B 37/08* (2013.01); *B65B 51/26* (2013.01)

(58) Field of Classification Search
CPC ..... B65B 1/06; B65B 29/028; B65B 11/48; B65B 37/02; B65B 37/08; B65B 51/26
See application file for complete search history.

(56) References Cited

U.S. PATENT DOCUMENTS 4,571,924 A * 2/1986 Bahrani ..... B65B 9/042 53/579

FOREIGN PATENT DOCUMENTS

| | | |
|---|---|---|
| EP | 0226939 A2 | 7/1987 |
| GB | 295560 A | 8/1928 |

(Continued)

OTHER PUBLICATIONS

International Search Report and Written Opinion dated Jan. 8, 2020 from counterpart International Patent Application No. PCT/IB2019/052248.

*Primary Examiner* — Anna K Kinsaul
*Assistant Examiner* — Himchan Song
(74) *Attorney, Agent, or Firm* — SHUTTLEWORTH & INGERSOLL, PLC; Timothy J. Klima

(57) ABSTRACT

A machine for manufacturing pouches containing a cohesionless material, including feed means for feeding the cohesionless material to a pick-up station, a transfer drum by which the material is picked up at the pick-up station and transferred to a release station, delivery means operating at the release station and by which portions of the material are delivered from the transfer drum through a duct toward a wrapping station at which the portions are sealed in pouches, and a mixer located at the pick-up station for performing a mixing action on the material at the pick-up station before the material is picked up by the transfer drum.

25 Claims, 6 Drawing Sheets

(56) References Cited

FOREIGN PATENT DOCUMENTS

| | | | | |
|---|---|---|---|---|
| WO | 2008114122 | A2 | 9/2008 | |
| WO | 2008114132 | A1 | 9/2008 | |
| WO | 2008114133 | A1 | 9/2008 | |
| WO | WO-2008114133 | A1 * | 9/2008 | ..... B29C 65/08 |

* cited by examiner

MACHINE AND A PROCESS FOR MANUFACTURING POUCHES CONTAINING A COHESIONLESS MATERIAL

This application is the National Phase of International Application PCT/IB20201052248 filed Mar. 20, 2019 which designated the U.S.

TECHNICAL FIELD

The present invention relates to a machine and a process for manufacturing pouches containing a cohesionless material as powder or fibers, for example coffee, tea, cellulose fibers and others. The invention is particularly applicable for the use with fibers having a dimension comprised between 50 and 250 μm.

BACKGROUND ART

As regards the production of pouches with a filling material, the prior art embraces machines where a transfer drum is used to pick up a material from an accumulation zone and to transport the material, in the form of a continuous stream, to a delivery station where a succession of portions of the stream is separated in a discrete way. Each portion, constituting a dose, is then enclosed in a pouch and sealed according to known flowpack methods.

Such machines are generally provided for use with fiber materials, for example tobacco, which are held by suction onto the outer surfaces of the transfer drum from the accumulation zone to the delivery station. In particular the suction drum is furnished on its periphery with a series of through suction holes which are connected to an internal suction chamber of the drum. These drums are designed for an optimized action on such fiber materials and it has been shown that they do not correctly work on cohesionless materials having small dimension particles. Mainly for technologic reasons, the holes on the suction drum have a diameter of 0.5 mm or more, which is enough to provide a sufficient suction holding of tobacco fibers with, at the same time, an easy workability of the outer mantle of the drum.

This structure of the known transfer drums does not allow for a correct and reliable use of cohesionless materials of granular or powder form, or even a fiber form, having smaller dimension. These materials have the tendency to reach the suction chamber within the transfer drum and to collect therein due to their smaller dimension than the suction holes, on one side, and to stick together at the accumulation zone, on the other side. This leads to undesired clogging of the entire machine that must repeatedly be stopped to allow for a manual removal of the clogged portions.

DISCLOSURE OF THE INVENTION

The object of the present invention, accordingly, is to overcome the drawbacks described above.

The drawbacks are overcome by a machine and by a process as disclosed herein.

BRIEF DESCRIPTION OF THE DRAWINGS

The invention will now be described in detail, by way of example, with the aid of the accompanying drawings, in which.

DETAILED DESCRIPTION OF THE PREFERRED EMBODIMENTS OF THE INVENTION

Figure 1:
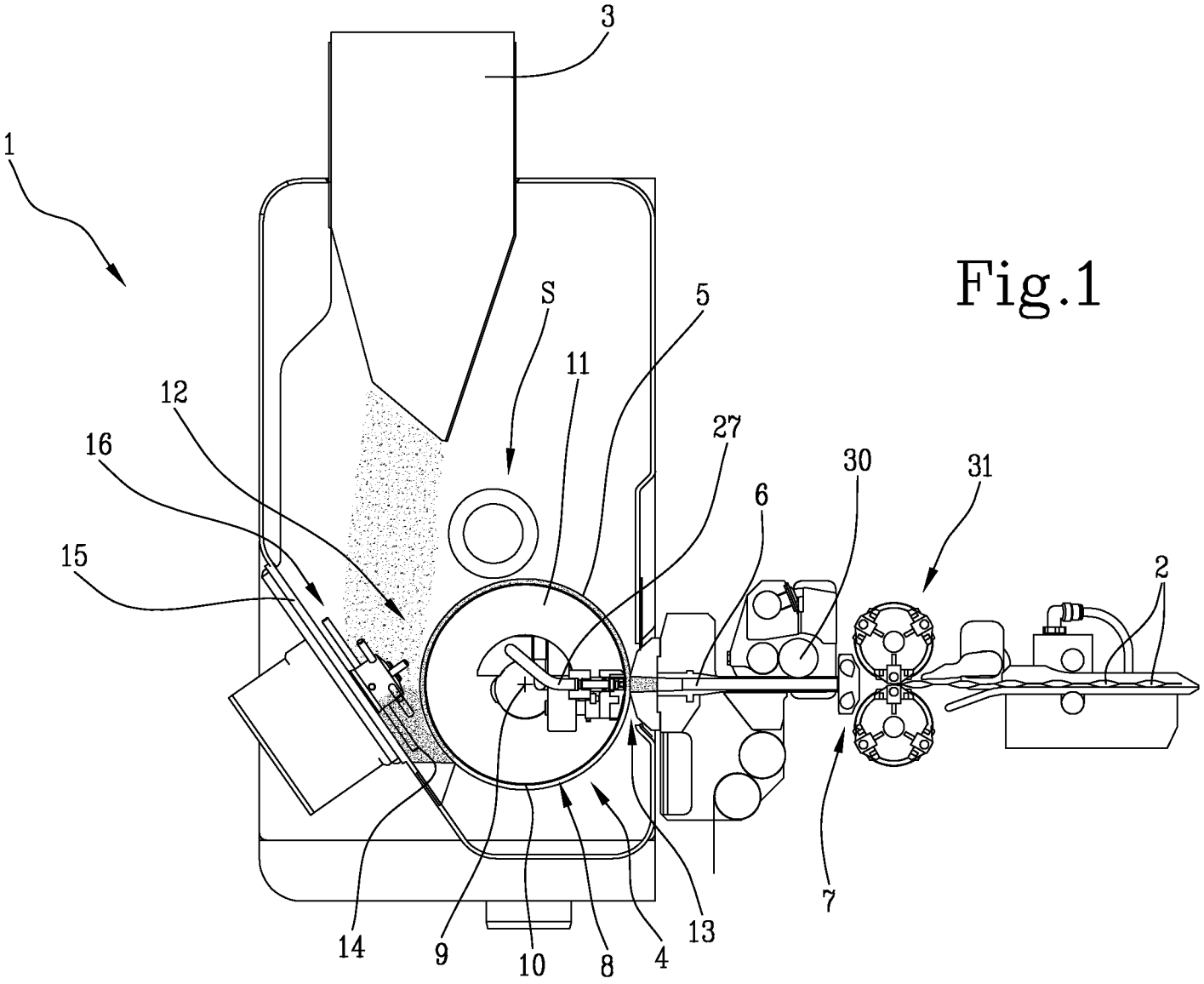
FIG. 1 illustrates a machine according to the present invention for manufacturing pouches of a cohesionless material, viewed schematically in a front elevation.
Figure 2:
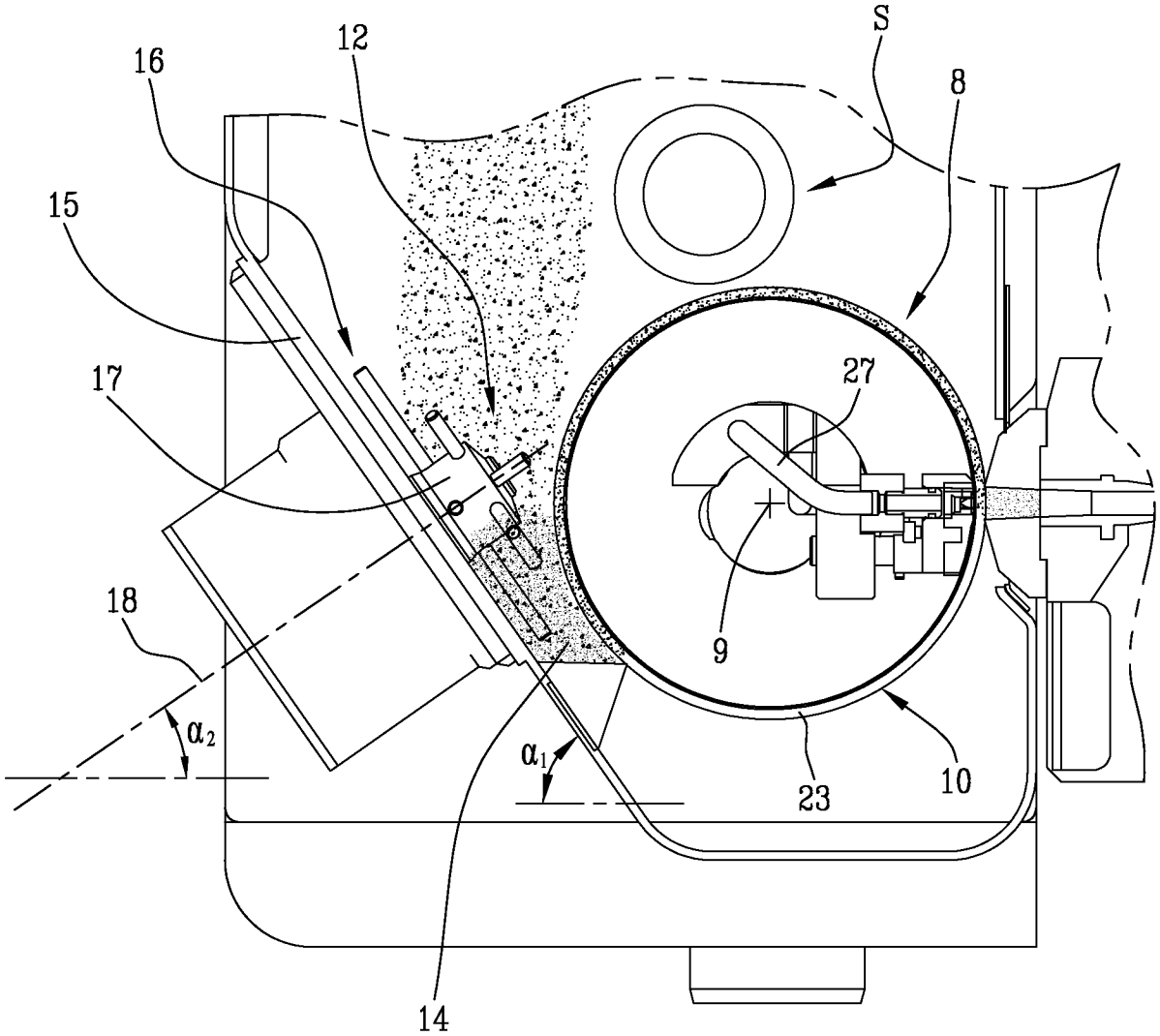
FIG. 2 shows an enlarged detail of FIG. 1.
Figure 4:
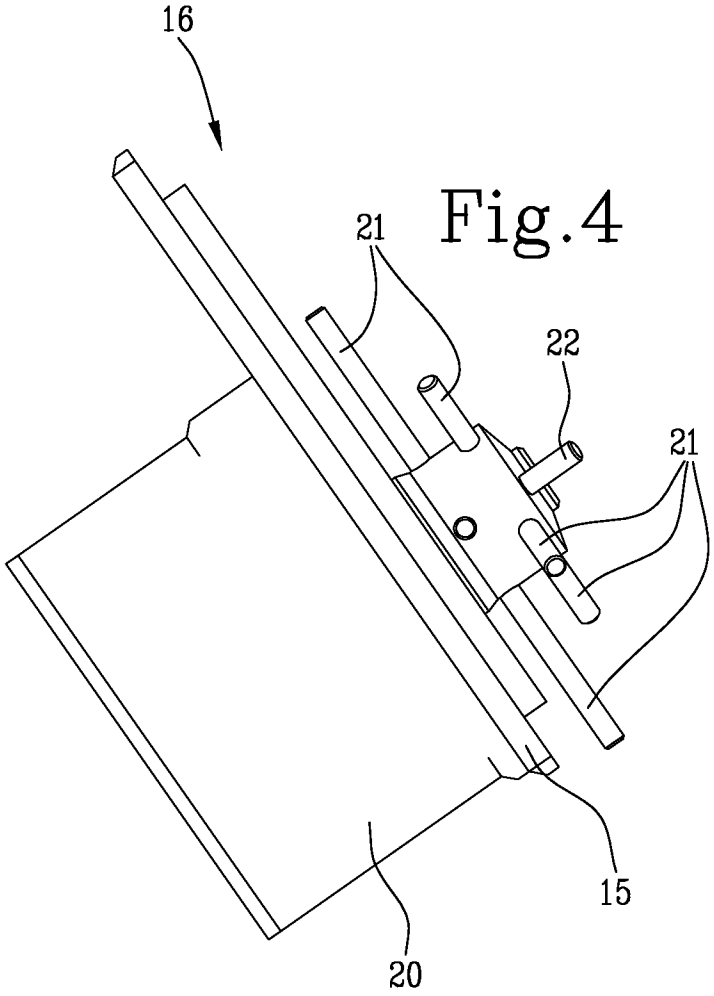
FIGS. 3 to 6 show in detail a part of the machine of FIG. 1, respectively in a section view and in side, perspective and front views.
Figure 3:
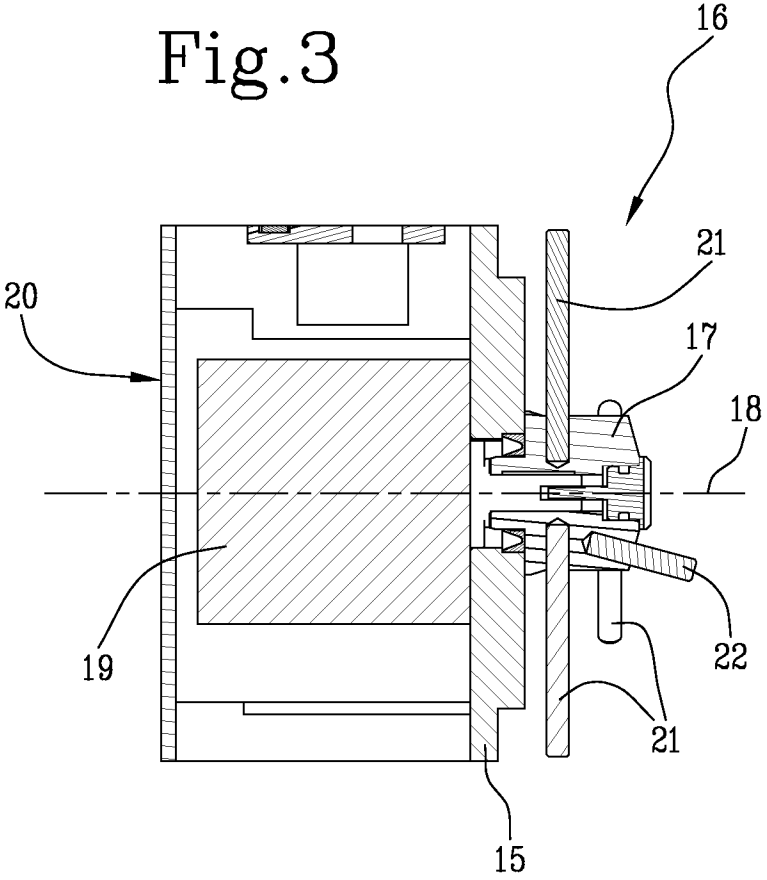
Figure 6:
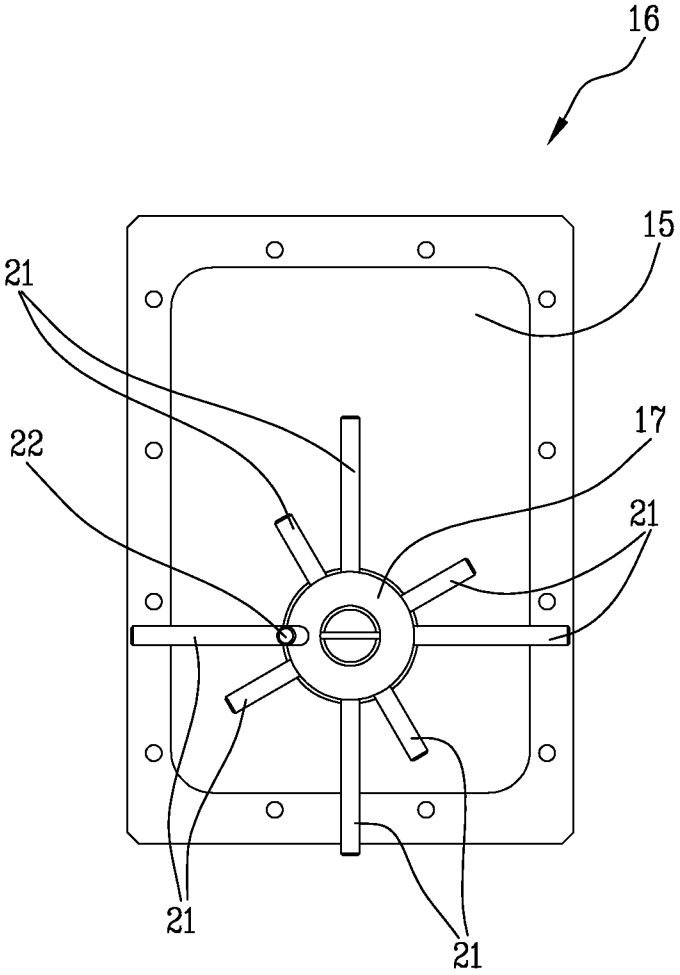
Figure 5:
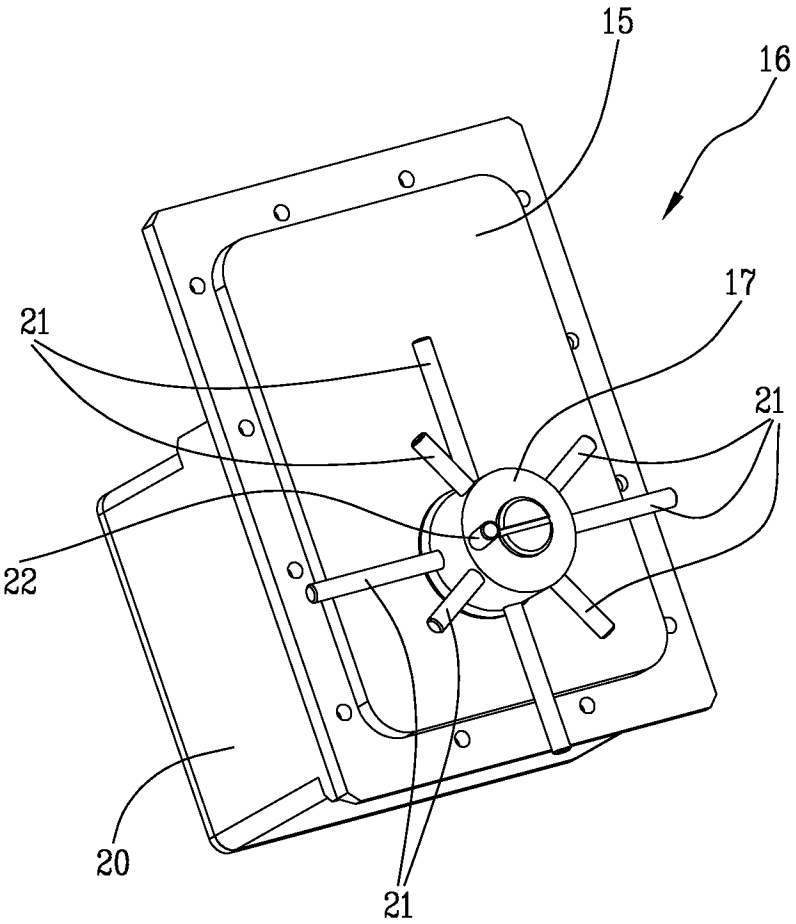

With reference to FIGS. 1 and 2, numeral 1 denotes a machine used in the manufacture of pouches 2 containing a cohesionless material. The cohesionless material can be in the form of powder or fibers and is made of particles having a dimension comprised between 50 μm and 250 μm. As an example, which does not constitute a restriction, the material can be coffee powder, tea particles from leaves, cellulose fibers.

The machine 1 comprises a hopper 3 serving as means of storing and feeding the material by gravity, connected by way of conveyor means 4 on which to form a continuous stream 5 of the mixture, and by a rectilinear duct 6, to a wrapping and sealing station 7 where the pouches 2 are fashioned.

More in detail, such conveyor means 4 comprise a transfer drum 8 rotatable about a horizontal rotation axis 9, presenting a cylindrical wall 10 and enclosed by two mutually opposed side walls 11 (one only of which is visible in FIG. 1).

The drum 8 rotates intermittently about the axis 9 in a clockwise direction, as viewed in the drawings, through steps of predetermined angular distance, and is arranged between a pick-up station 12, located below the hopper 3 and where the transfer drum 8 picks up the material, and a release station 13 downstream of the pick-up station 12 where portions of the material forming part of the stream 5 are delivered from the transfer drum 8 to the rectilinear duct 6.

The pick-up station 12 comprises a nip 14 defined between a part of the cylindrical wall 10 of the transfer drum 8 and a side wall 15 so that the cylindrical wall 10 and the side wall 15 laterally delimit the nip 14 on opposite sides. The side wall 15 can be defined by a part of a containing structure which surrounds the nip 14 and a vertical channel above, from which the material falls by gravity after exiting the hopper 3.

According to other embodiments, not shown, the nip can be replaced by a generic accumulation zone where a sufficient quantity of material is accumulated so that the transfer drum 8 can enter in contact with the accumulated material so as to pick-up the material and form the aforementioned continuous stream 5 on the transfer drum 8.

Advantageously, the machine 1 further comprises a mixer 16 or agitator, located at the pick-up station 12, in particular at least partly arranged in the nip 14 or more generally in the accumulation zone and configured for performing a mixing action on the material (in the nip 14) immediately before the material is picked up by the transfer drum 8. This allows to prevent the cohesionless material from compacting and creating a state of solidity.

The mixer 16 is mounted on the side wall 15, preferably in a cantilevered manner, and arranged in such a way that it is at least covered by the material collected by gravity in the nip 14.

More in detail, the mixer 16 comprises a rotating hub 17 which is mounted for rotation about a respective rotation axis 18 and is coupled with a pneumatic actuator or an electric motor 19 for setting the hub 17 in rotation about the axis 18 and which can be enclosed in a respective housing 20. The rotating hub 17 is located in a position facing the cylindrical wall 10 of the transfer drum 8.

The hub 17 can be rotated continuously or intermittently in either a clockwise or anti-clockwise direction, as viewed in the figures, or can oscillate through steps of predetermined angular distance.

Mounted on the rotating hub 17 are one or more pins 21 (FIGS. 3-6) which are arranged perpendicularly (or anyway transversely) to the rotation axis 18 of the rotating hub 17.

The pins 21 are mounted on the rotating hub 17 at different positions along the rotation axis 18 of the rotating hub 17, preferably in such a way that for each position along the axis 18 more than one pin 21 is arranged on the rotating hub 17 according to an angular distribution about the rotation axis 18 of the rotating hub 17. In other words, on the rotating hub 17 and along its rotating axis 18 two or more sections (positions or stages) can be identified, where two or more pins 21 are arranged and angularly distributed about the axis 18 so as to prevent cohesionless material compaction. In the embodiment of FIGS. 3-6 two positions are shown and at each position four pins 21 are arranged, equally distributed at an angular spacing of 90°. Moreover, the pins 21 of different positions can be angularly shifted, as for example in the embodiments of FIGS. 3-6 the four pins of one position are angularly shifted of 45° with respect to the four pins 21 of the other position.

The pins 21 have a round or elliptical section or can have a section shaped in a fashion to allow the free passage of the hub 17 with the pins 21 through the cohesionless material in the nip 14 without altering the properties of the material. Moreover, the pins 21 are preferably mounted on the hub 17 in a freely rotating manner about their longitudinal axis or, alternatively, the pins 21 can be fixed to the hub 17. The longitudinal axes of the pins 21 is transversal or perpendicular (generally "radial") to the rotation axis 18 of the hub 17.

According to a preferred solution, the pins 21 have respective lengths, measured perpendicularly with respect to the rotation axis 18 of the rotating hub 17, which decrease along the rotation axis 18 of the rotating hub 17 and in particular in a direction away from the side wall 15 and towards the transfer drum 8. This configuration confers to the mixer 16 a generally tapered configuration towards the transfer drum 8. In other words, the second stage of pins is furnished with shorter pins than the first stage. This assists in the advancement of the cohesionless material towards the transfer drum 8.

Preferably, the mixer 16 further comprises at least one additional pin 22 which is arranged with its main axis transversal, but not perpendicular, to the rotation axis 18 of the rotating hub 17. This additional pin 22 is located in a closer position to the transfer drum 8 and projects towards the transfer drum 8, preferably beyond the front edge of the rotating hub 17, so as to perform a stirring action on the material in the nip 14. The at least one additional pin 22 constitutes a last stage (third stage in this case) where the additional pin 22 moves to define a conical outline.

In the shown embodiment, the side wall 15, and in particular at least a portion thereof to which the mixer is mounted, has a planar or flat configuration.

Preferably, the side wall 15 lays on a plane which is inclined of a base angle "$\alpha_1$" with respect to a vertical plane which includes the rotating axis 9 of the transfer drum 8. This confers a downwards tapered shape to the nip 14, in particular to the portion of the nip 14 where the mixer is located, so that the tapered outline of the mixer 16 matches with the corresponding tapered shape of the nip 14 (as can be seen in FIG. 2). The base angle "$\alpha_1$" is comprised between 20° and 70° and preferably comprised between 40° and 50°.

Moreover, the rotation axis 18 of the rotating hub 17 lays in a vertical plane and is inclined of a mixing angle "$\alpha_2$" with respect to a horizontal plane. The mixing angle "$\alpha_2$" is comprised between 20° and 70° and preferably comprised between 40° and 50°.

Figure 8:
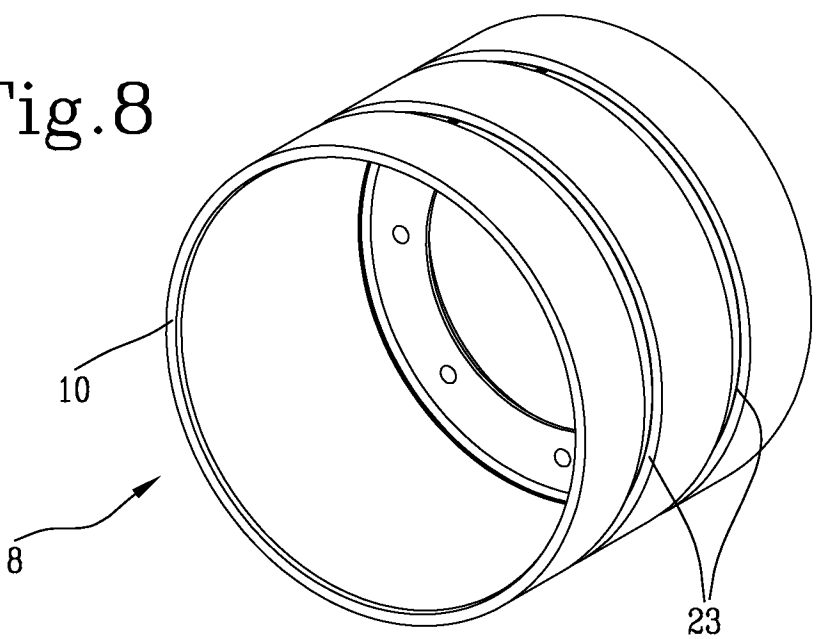

In a preferred solution, the rotation axis 18 of the rotating hub 17 is perpendicular to the side wall 15. In order to pick-up and transfer the cohesionless material, the cylindrical wall 10 of the drum 8 presents one or more circumferential grooves 23 (FIG. 8) of annular shape and predetermined width. In the following description reference will be made to a transfer drum 8 having a single circumferential groove 23, anyway the invention is applicable to multi-track transfer drums having any number of circumferential grooves as well, where the grooves are axially spaced along the rotation axis 9 of the transfer drum 8 as shown in FIG. 8.

The circumferential groove 23 is furnished along its entire circumferential length with through holes 24 (only partly shown in FIG. 7) communicating with an internal chamber of the transfer drum 8 to transfer the material in the form of continuous streams. The additional pin 22 sweeps in an arc from each circumferential groove 23 within the transfer drum 8 to prevent voids from developing within the continuous streams 5 as the cohesionless material is vacuumed into the circumferential grooves 23 of the rotating drum 8.

Figure 9A:
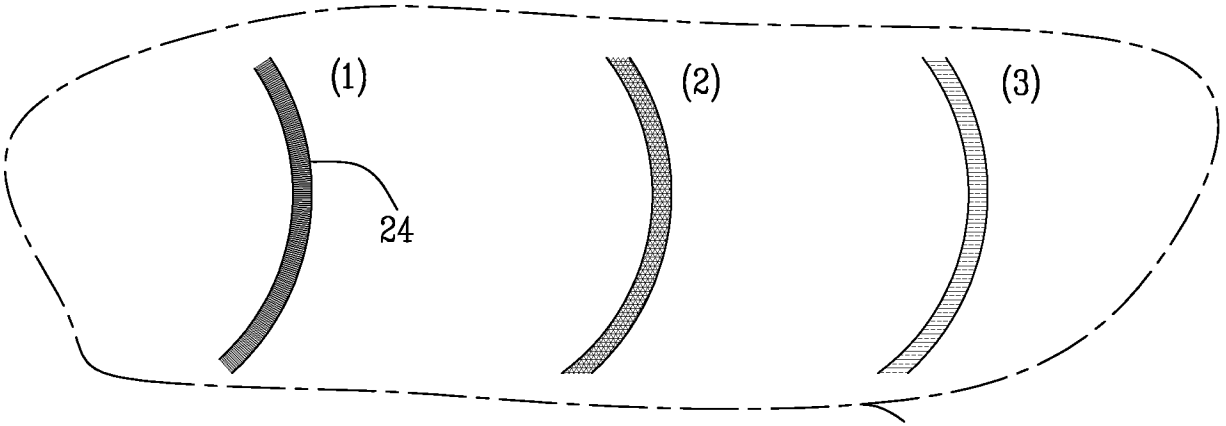
FIG. 9A shows details of the mantle of FIGS. 8 and 9 according to different embodiments.
Figure 9:
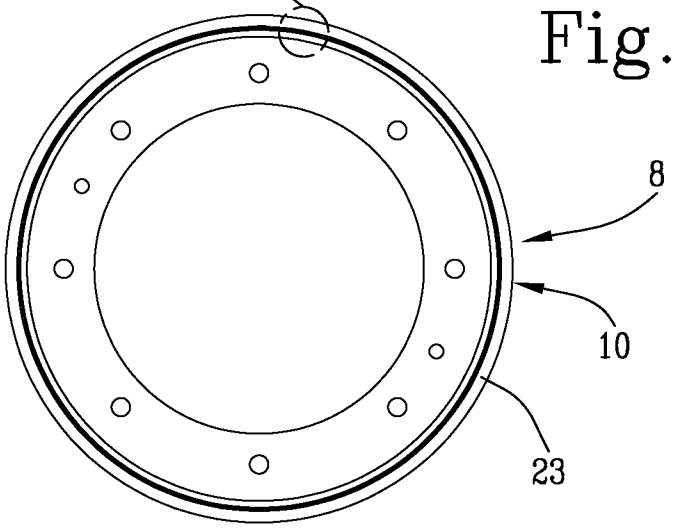
FIGS. 8 and 9 show the outer mantle of a transfer drum employed in the machine of FIG. 1.

In one embodiment, the through holes 24 are formed as apertures in the cylindrical wall 10 of the transfer drum 8, for example by laser techniques. This holes are shown in FIG. 9A(1). The holes have a diameter or a transverse section less than 200 μm and preferably less than 50 μm.

In other embodiments, the circumferential groove 23 is equipped with a circumferential permeable strip applied to the transfer drum 8 and having through openings smaller than 200 μm and preferably smaller than 50 μm. The circumferential permeable strip can made of a dense wire mesh, as in FIG. 9A(2), or can be made of a printed or sintered metal, as in FIG. 9A(3).

The machine 1 can further comprise a scraping member "S" adjacent to the transfer drum 8 for scraping the material of the continuous stream 5 transferred by the transfer drum 8 from the pick-up station 12 to the release station 13.

The scraping member "S" is preferably in the form of a rotating roller having a cylindrical outline and a rotation axis parallel to the rotation axis 9 of the transfer drum 8. Alternatively, the scraping member "S" can have a non-cylindrical outline, for example by having a polygonal section.

Figure 7:
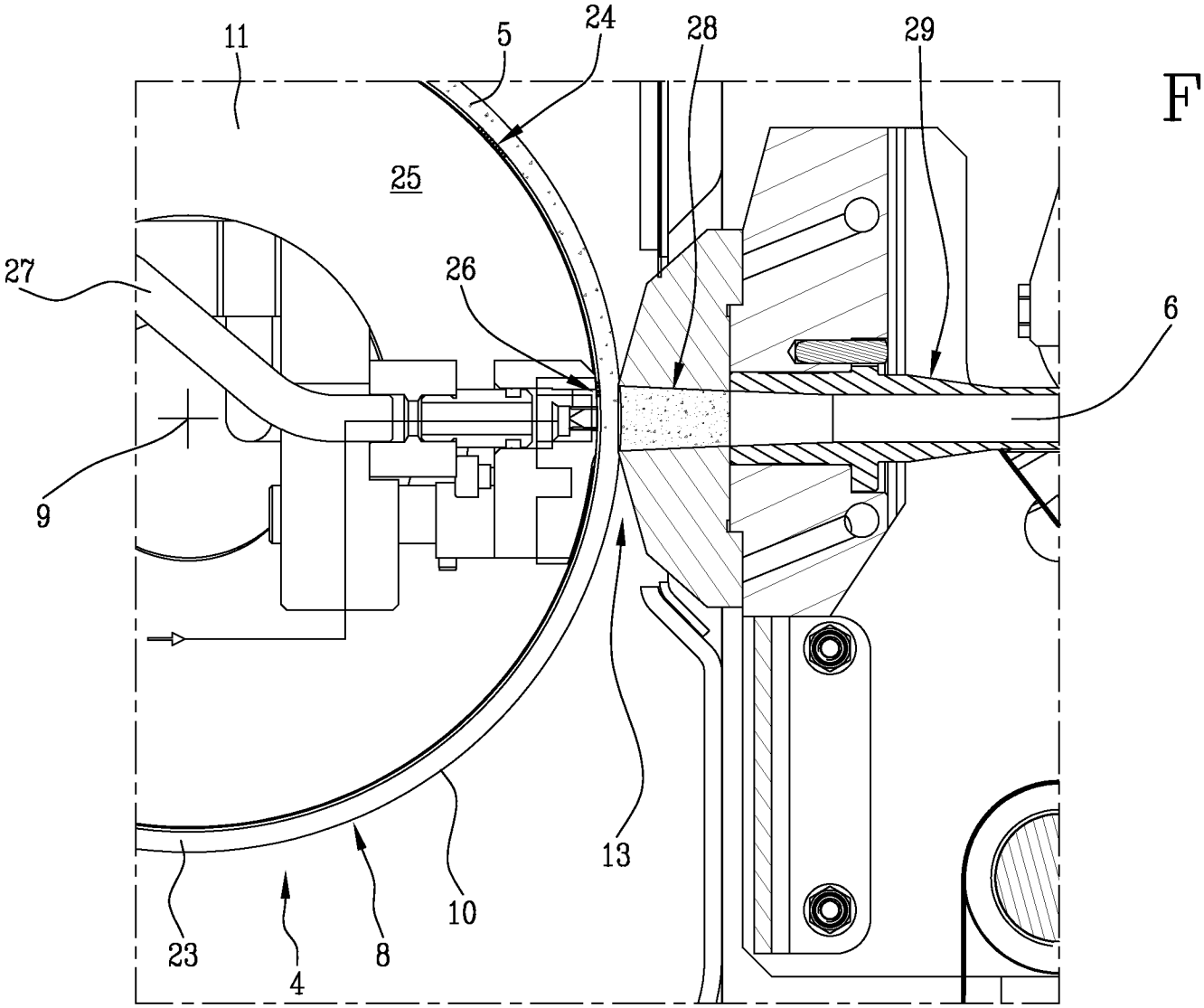
FIG. 7 shows another enlarged detail of FIG. 1.

The internal chamber of the transfer drum 8 is divided into a first sector 25 and a second sector 26 (FIG. 7).

The second sector 26, which extends through an arc of predetermined width, is sandwiched between the two ends of the first sector 25 and positioned to coincide with the release station 13.

The first sector 25 is connected by way of a duct (not shown) to a source of negative pressure so that the through holes 24 of the circumferential groove 23 act as suction holes to retain the continuous stream 5 of material into the groove 23.

The second sector 26 is connected via a duct 27 to a pneumatic source (not shown) to perform shots of compressed air by which segments of the stream 5 are separated from the transfer drum 8 to be delivered to the rectilinear duct 6. The duct 27, as well as any nozzle mounted thereon to regulate the air ejection, act therefore as (or form part of) a delivery means of the doses of material, namely the segments of stream 5.

The rectilinear duct 6 comprises an inlet portion or mouth 28 of funnelform appearance, facing the sector of the drum coinciding with the transfer station 13, and a tubular body 29 (FIG. 7).

About an end portion of the tubular body 29, or about an additional tubular mandrel aligned and connected thereto, a tubular envelope of paper wrapping material (unwound from a roll, not illustrated) is fashioned through the agency of conventional folding means (not illustrated).

The tubular envelope is sealed longitudinally by first sealing means 30 (FIG. 1).

The envelope is then sealed transversely by second sealing means 31 operating downstream of the first sealing means 30 and comprising, in the shown embodiment, an upper set of three heated sealing anvils and a lower set of three heated sealing anvils, spring loaded each other to provide the sealing function. The upper set of sealing anvils contains a knurled pattern along the sealing surface while the lower set can have just a smooth sealing surface.

In operation, with the drum 8 rotating intermittently, the cohesionless material released from the hopper 3 is collected into the nip 14 and picked up from the transfer drum 8 so that a continuous stream 5 is formed in the circumferential groove 23. During this process, a (preferably continuous) rotation movement of the mixer 16 assists in maintaining a correct homogeneous form of the material in the nip 14 so as to avoid any clogging of the machine.

The continuous stream 5 advances into the transfer station 13 where, with each step indexed by the drum 8 (in a clockwise direction), a jet of compressed air is delivered at the second sector 17 through the relative holes 24, causing a segment of the stream 5 to be ejected from the groove 23. In more detail, when the transfer drum 8 completes one indexed rotation step in the clockwise direction, the transfer drum 8 then rotates back in a counter-clockwise direction for another predetermined angle (usually) 10°. This allows in clearing the holes 24 within the drum 8 to prevent the new start wall of the cohesionless stream 5 from falling into the empty portion of the channel that has been ejected. This last cleaning action prevents any excessive cohesionless material from falling into the air stream and also ensures consistent product dosing and helps in keeping the end seal of the pouch clear of product at the end of a pouch cycle.

The segment of material is directed by the compressed air through the funnelform mouth 28 into the tubular body 29 of the rectilinear feed duct 6. The ejected segment is of predetermined length corresponding to a single wrappable portion or dose of material.

Emerging from the rectilinear duct 6, the portion of material enters the aforementioned tubular envelope of wrapping material which is fashioned progressively by a conventional forming method.

The tubular envelope is closed up longitudinally by the first sealing means 30.

The tubular envelope containing the successive portions of material is engaged transversely by the second sealing means 31, operating intermittently and timed to match the frequency with which the portions are ejected, in such a way that each portion will be enclosed between two successive transverse seals.

As a result of these operations, a continuous succession of filled pouches 2 is obtained, connected one to the next by way of the transverse seals. Downstream of the transverse sealing means 31, the single pouches 2 are separated one from the next by cutting means (not shown).

The invention achieves the advantage of producing pouches filled with a cohesionless material having a very small particle size (from 50 to 250 μm) with a high level of reliability, in particular reducing the risks of clogging of the machine which is usually caused by the use of such small particles. In particular, the mixer allows to maintain a state of fluidity without altering the cohesionless material. The mixer also allows the cohesionless material to easily advance towards the transfer drum minimizing voids within the body of the cohesionless material. This also leads to an optimized and consistent stream being maintained along the annular grooves of the transfer drum.

The invention claimed is:

1. A machine for manufacturing pouches containing a cohesionless material, comprising:

a feed device for feeding the cohesionless material to a pick-up station, a transfer drum by which the material is picked up at the pick-up station and transferred to a release station, a delivery device operating at the release station and by which portions of the material are delivered from the transfer drum through a duct toward a wrapping station at which the portions are sealed in pouches, a mixer located at the pick-up station for performing a mixing action on the material at the pick-up station before the material is picked up by the transfer drum;

wherein the pick-up station comprises a nip defined between a part of an outer cylindrical wall of the transfer drum and a side wall, the feed device including a hopper being configured to release material into the nip by gravity, and wherein the mixer is at least partly arranged in the nip; and wherein the mixer comprises a rotating hub and one or more pins mounted on the rotating hub and arranged transversely and/or perpendicularly to a rotation axis of the rotating hub.

2. The machine according to claim 1, wherein the mixer is mounted on the side wall in a cantilevered manner.

3. The machine according to claim 1, wherein the pins are mounted on the rotating hub at different positions along the rotation axis of the rotating hub and wherein the pins have respective lengths, measured perpendicularly with respect to the rotation axis of the rotating hub, which decrease along the rotation axis of the rotating hub.

4. The machine according to claim 3, wherein the rotating hub is arranged in a facing relationship with respect to the transfer drum and wherein said respective lengths of the pins decrease along the rotation axis of the rotating hub towards the transfer drum.

5. The machine according to claim 3, wherein, for each position along the rotation axis of the rotating hub, more than one of the pins is arranged on the rotating hub according to an angular distribution about the rotation axis of the rotating hub.

6. The machine according to claim 1, wherein at least some of the pins are arranged with respective main axes perpendicular to the rotation axis of the rotating hub.

7. The machine according to claim 6, further comprising an additional pin which is arranged having a main axis transversal, but not perpendicular, to the rotation axis of the rotating hub.

8. The machine according to claim 7, wherein said additional pin is located in a closer position to the transfer drum and projects towards the transfer drum to perform a stirring action on the material in the nip.

9. The machine according to claim 1, wherein the transfer drum rotates about a horizontal rotation axis which lays in a vertical plane and wherein the side wall lays on a plane which is inclined of a base angle with respect to said vertical plane.

10. The machine according to claim 9, wherein the base angle is comprised between 20° and 70°.

11. The machine according to claim 1, wherein the transfer drum rotates about a horizontal rotation axis and wherein the rotation axis of the rotating hub lays in a vertical plane and is inclined of a mixing angle with respect to a horizontal plane.

12. The machine according to claim 11, wherein the mixing angle is comprised between 40° and 50°.

13. The machine according to claim 1, wherein the side wall is flat and wherein the rotation axis of the rotating hub is perpendicular to the side wall.

14. The machine according to claim 1, and further comprising a scraping member adjacent to the transfer drum for scraping the material transferred by the transfer drum from the pick-up station to the release station.

15. The machine according to claim 14, wherein the scraping member is a rotating roller having a cylindrical outline and a rotation axis parallel to the rotation axis of the transfer drum.

16. The machine according to claim 1, wherein the transfer drum includes a circumferential groove for retaining the material in the form of a continuous stream of material from the pick-up station to the release station, and wherein the circumferential groove includes suction holes communicating with an internal suction chamber of the transfer drum and having a diameter or transverse dimension less than 50 μm.

17. The machine according to claim 16, wherein the transfer drum is configured as multi-track conveyor and has two or more circumferential grooves axially spaced along a rotation axis of the transfer drum.

18. The machine according to claim 1, wherein the transfer drum includes a circumferential groove for retaining the material in the form of a continuous stream of material from the pick-up station to the release station, and wherein the circumferential groove includes a circumferential permeable strip applied to the transfer drum and having through openings smaller than 200 μm, the through openings communicating with at least one internal suction chamber of the transfer drum.

19. The machine according to claim 18, wherein the circumferential permeable strip is made of a dense wire mesh.

20. The machine according to claim 19, wherein the circumferential permeable strip is made of a printed or sintered metal.

21. A process for manufacturing pouches containing a cohesionless material, comprising:

feeding a cohesionless material made of particles with a dimension comprised from 50 μm to 250 μm to a pick-up station, picking up the material at the pick-up station by a transfer drum and transferring the material in the form of a continuous stream by the transfer drum to a release station where the material is delivered through a duct toward a wrapping station at which the portions are sealed in pouches, mixing the material in the pick-up station by a mixer before the material is picked up by the transfer drum;

wherein the pick-up station comprises a nip defined between a part of an outer cylindrical wall of the transfer drum and a side wall, the feed device including a hopper being configured to release material into the nip by gravity, and wherein the mixer is at least partly arranged in the nip; and providing that the mixer comprises a rotating hub and one or more pins mounted on the rotating hub and arranged transversely and/or perpendicularly to a rotation axis of the rotating hub.

22. The process according to claim 21, wherein the steps of picking-up the material from the pick-up station and transferring the material towards the release station by the transfer drum is performed by using a transfer drum having at least one circumferential groove with suction openings, wherein the suction openings have a diameter or transverse dimension less than 50 μm.

23. The process according to claim 21, performed with a machine.

24. A machine for manufacturing pouches containing a cohesionless material, comprising:

a feed device for feeding the cohesionless material to a pick-up station, a transfer drum by which the material is picked up at the pick-up station and transferred to a release station, a delivery device operating at the release station and by which portions of the material are delivered from the transfer drum through a duct toward a wrapping station at which the portions are sealed in pouches, a mixer located at the pick-up station for performing a mixing action on the material at the pick-up station before the material is picked up by the transfer drum, the mixer including a rotating hub;

wherein the pick-up station comprises a nip defined between a part of an outer cylindrical wall of the transfer drum and a side wall, the feed device including a hopper being configured to release material into the nip by gravity, and wherein the mixer is at least partly arranged in the nip;

wherein the transfer drum rotates about a horizontal rotation axis and wherein a rotation axis of the rotating hub lies in a vertical plane and is inclined of a mixing angle with respect to a horizontal plane.

25. A process for manufacturing pouches containing a cohesionless material, comprising:

feeding with a feed device a cohesionless material made of particles with a dimension comprised from 50 μm to 250 μm to a pick-up station, picking up the material at the pick-up station by a transfer drum and transferring the material in the form of a continuous stream by the transfer drum to a release station where the material is delivered through a duct toward a wrapping station at which the portions are sealed in pouches, mixing the material in the pick-up station by a mixer before the material is picked up by the transfer drum, the mixer including a rotating hub;

providing that the pick-up station comprises a nip defined between a part of an outer cylindrical wall of the transfer drum and a side wall, the feed device including a hopper being configured to release material into the nip by gravity, and wherein the mixer is at least partly arranged in the nip;

providing that the transfer drum rotates about a horizontal rotation axis and wherein a rotation axis of the rotating hub lies in a vertical plane and is inclined of a mixing angle with respect to a horizontal plane.

* * * * *